US005894822A

United States Patent [19]

Speil

[11] Patent Number: 5,894,822

[45] Date of Patent: Apr. 20, 1999

[54] SUPPORT ELEMENT FOR A FINGER LEVER OF A VALVE DRIVE OF AN INTERNAL COMBUSTION ENGINE

[76] Inventor: Walter Speil, Friedrich-Ebert-Strasse 60b, 85055 Ingolstadt, Germany

[21] Appl. No.: 08/952,423

[22] PCT Filed: Mar. 29, 1996

[86] PCT No.: PCT/EP96/01391

§ 371 Date: Nov. 18, 1997

§ 102(e) Date: Nov. 18, 1997

[87] PCT Pub. No.: WO96/36794

PCT Pub. Date: Nov. 21, 1996

[30] Foreign Application Priority Data

May 18, 1995 [DE] Germany ..... 195 18 290

[51] Int. Cl.[6] ..... F01L 1/24

[52] U.S. Cl. ..... 123/90.43; 123/90.46; 123/90.36

[58] Field of Search ..... 123/90.36, 90.39, 123/90.41, 90.42, 90.43, 90.45, 90.46, 90.55

[56] References Cited

U.S. PATENT DOCUMENTS

| | | | |
|---|---|---|---|
| 4,004,558 | 1/1977 | Scheibe | 123/90.43 |
| 4,807,576 | 2/1989 | Sonoda et al. | 123/90.43 |
| 5,311,845 | 5/1994 | Takahashi | 123/90.43 |

FOREIGN PATENT DOCUMENTS

| | | |
|---|---|---|
| 0 332 359 | 9/1989 | European Pat. Off. . |
| 60-195318 | 10/1985 | Japan . |
| 2 108 620 | 5/1983 | United Kingdom . |

*Primary Examiner*—Weilun Lo

*Attorney, Agent, or Firm*—Panitch, Schwarze, Jacobs & Nadel, P.C.

[57] ABSTRACT

The outer peripheral surface of the housing (2) of a support element (1) for a finger lever of a valve drive of an internal combustion engine comprises a serration toothing (13) which is pressed into a reception bore (4) of a cylinder head (5) during mounting. During pressing-in, material is sheared off the tooth tips and displaced wholly or partly into the gaps between the teeth towards the root of the toothing. In this way, the clearance compensation element (1) is retained secure against rotation in the reception bore (4).

12 Claims, 3 Drawing Sheets

SUPPORT ELEMENT FOR A FINGER LEVER OF A VALVE DRIVE OF AN INTERNAL COMBUSTION ENGINE

BACKGROUND OR THE INVENTION

The invention concerns a support element for a finger lever of a valve drive of an internal combustion engine comprising a hollow cylindrical housing arranged in a reception bore of a cylinder head, a slidable inner element arranged within the housing being supported by a compression spring on the housing, while one end of the housing cooperates with the cylinder head, and one end of the inner element cooperates with the finger lever.

A support element of the pre-cited type is known from EP 03 32 359 B1. The housing of the support element is retained in the bore of the cylinder by a ring. A drawback of this construction is that an additional groove has to be made in the housing and mounting is rendered more difficult because of the additional locking ring required. Besides this, this method of fixing does not secure the housing against rotation in the reception bore.

It is also known in this connection to retain the housing of the support element in the reception bore by groove and spring retention means.

However, a drawback of such methods is the difficulty of manufacturing and the problematic assembly. It is further known to fix the housing on the outer diameter with the help of a screw thread. In this case, besides the expensive manufacturing, there exists the danger of a binding of the slidable inner element if the tightening torque of the hollow cylindrical housing is too high. Finally, it is also possible to fix the housing in the reception bore of the cylinder head by a press fit. This, however, requires very precise matching of sizes and there is the danger of clamping of the inner element in the housing. In addition, this type of fixing does not permit dismounting.

SUMMARY OF THE INVENTION

It is therefore the object of the invention to provide a fixing of the housing in the cylinder head which enables a mounting and dismounting of the support element in a simple manner while avoiding the hitherto experienced drawbacks, and to provide simple means to prevent rotation of the housing.

The invention achieves this object in that the outer peripheral surface of the housing comprises a serration toothing which is pressed into the reception bore during mounting, or that the housing is connected positively to a bushing whose outer peripheral surface comprises a serration toothing which is pressed into the reception bore during muonting.

In this way, when the housing is pressed into the reception bore of the cylinder head, material is sheared off the tooth tips and displaced wholly or partly into the gaps between the teeth towards the root of the toothing so that a strong retention of the housing is obtained which, at the same time, results in a good prevention of rotation of the housing. This high security against rotation is particularly important when support elements have to be mounted in an inclined or horizontal position in the cylinder head because, in this case, the radial bore for hydraulic medium supply must be located in the gravity-remote region, i.e. at the highest possible geodetic point of the entire arrangement to prevent an emptying of the central reservoir with the known adverse effects. The fixing of the housing in the reception bore of the cylinder head according to the invention assures by the displacement of material of the serration toothing, on the one hand, that a binding of the slidable inner element is prevented and on the other hand, that the reception bore to be made in the cylinder head can have a simple configuration. The serration toothing can be made unproblematically, for example by knurling, or directly during the extrusion of the housing. The arrangement of the support element according to FIGS. 5 and 6 of the invention has the further advantage of the invention has the further advantage that the support element can be easily dismounted because the housing is only positively connected to the bushing.

Further developments of the invention are the subject matter of the subclaims and will be described more closely in the following. According to one embodiment of the invention, the serration toothing extends over the entire periphery or over a part thereof and is arranged in an end region of the housing. The reason for the preferred advantageous location of the serration toothing in the end region of the housing is that because of the bottom, this part of the housing is the most stable and therefore creates a high degree of safety against a clamping of the slidable inner element. The larger the extent of the serration toothing over the periphery, the greater is the safety against rotation of the housing. In principle, however, it is also sufficient if a serration toothing with at least one tooth projection is provided.

According to the embodiment shown in FIG. 2, a diameter D of the reception bore is larger than a diameter d2 of an envelopping circle of the root of the toothing and smaller than a diameter d1 of an envelopping circle of the serration toothing, and that an area A1 defined by the diameters D and d1 is smaller than an area A2 defined by the diameters D and d2. These diameter and area ratios assure that an unimpeded displacement of material can take place during the pressing-in operation and that a firm seating of the housing in the reception bore is thus achieved.

According to another feature of the invention shown in FIG. 2, viewed in cross-section, the serration toothing has a triangular or a rectangular configuration. The type of cross-sectional configuration, however, has no influence on the quality of retention of the housing in the reception bore. However, it is also conceivable to use any other contours in addition to those described here, for example, a wavy shape of the serration toothing.

According to further features of the invention shown in FIGS. 3 and 4, the lower end of the reception bore comprises a step and the serration toothing possesses a conically tapering end region. With this configuration, a particularly firm seating of the housing in the cylinder head is realized because a toothed interference fit is established.

According to the embodiment shown in FIGS. 5 and 6, the housing and the bushing comprise at least one flattened portion each, and the bushing comprises the serration toothing in two regions situated diametrically opposite each other. This facilitates the pushing of the bushing onto the housing, and the opposing toothings assure a reliable retention of the housing in the reception bore.

According to one embodiment, the bushing is pot-shaped, i.e. it additionally comprises a bottom. Finally, according to one feature of the invention, the outer peripheral surface of the housing, or the outer peripheral surface of the bushing, as the case may be, comprises at least one flattened portion which cooperates with an associated flattened portion in the reception bore of the cylinder head. These corresponding flattened portions enable a directed installation of the housing in the reception bore of the cylinder head, i.e. the housing can be press-fitted by means of the serration toothing only in the proper installing position.

BRIEF DESCRIPTION OF THE DRAWINGS

The invention will now be described more closely with the help of the following examples of embodiment. The drawings show.

DETAILED DESCRIPTION OF THE INVENTION

Figure 1:
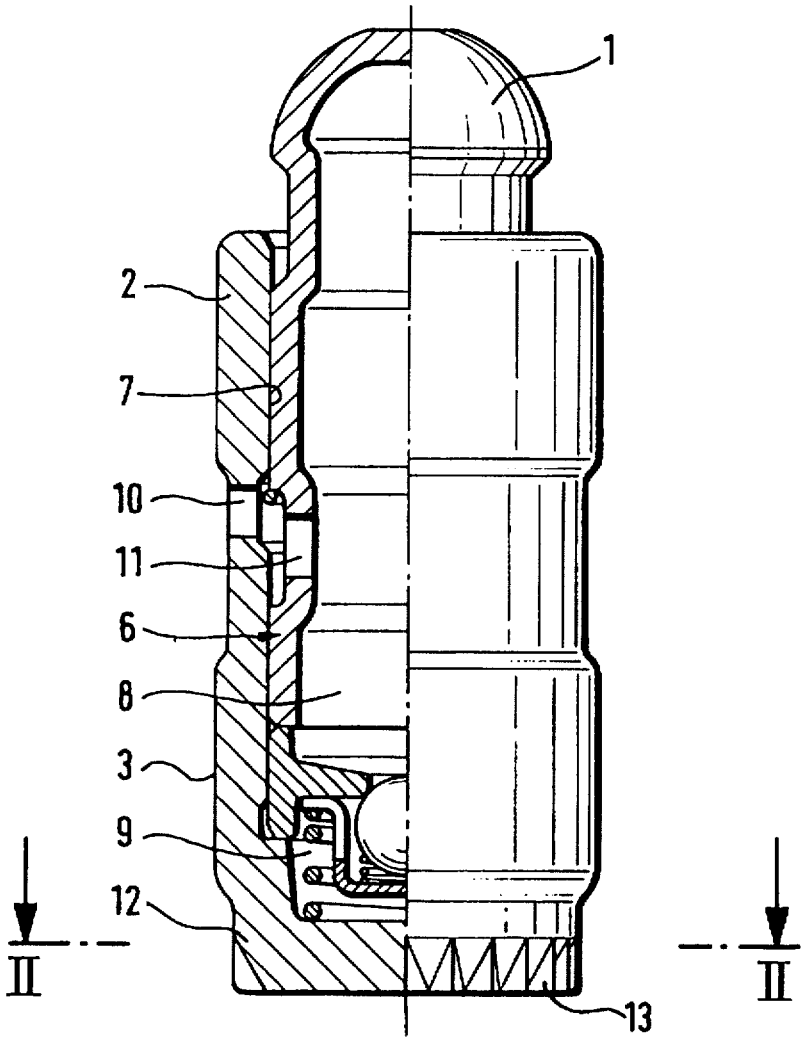
FIG. 1, a side view of a support element with a broken-out section.
Figure 3:
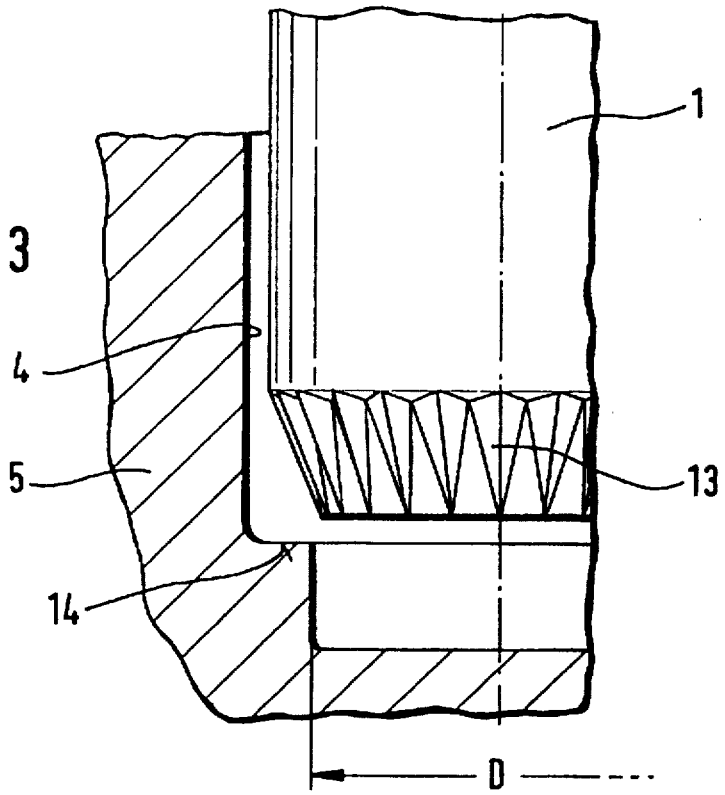
FIGS. 3,4, a schematic representation, in a partial longitudinal section, of a support element arranged in a cylinder head.
Figure 4:
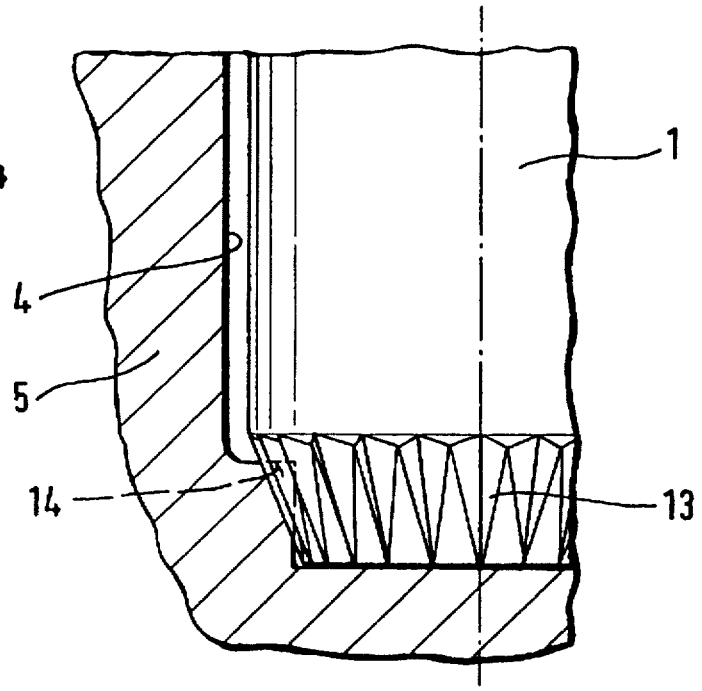

FIGS. 1, 3 and 4 show a support element 1 comprising a hollow cylindrical housing 2 which is installed with its outer peripheral surface 3 in a reception bore 4 of a cylinder head 5. The housing 2 encloses a two-part slidable inner element 6 which is received for axial displacement in a bore 7 of the housing 2. The inner element 6 encloses a hydraulic medium reservoir 8 which communicates with a high pressure chamber 9. The housing 2 and the inner element 6 each comprises a radial bore, 10 and 11 respectively, through which the reservoir 8 is supplied with hydraulic medium. According to the invention, the lower region 12 of the outer peripheral surface 3 of the housing 2 comprises a serration toothing 13 which is press-fitted into the reception bore 4 during mounting.

Figure 2:
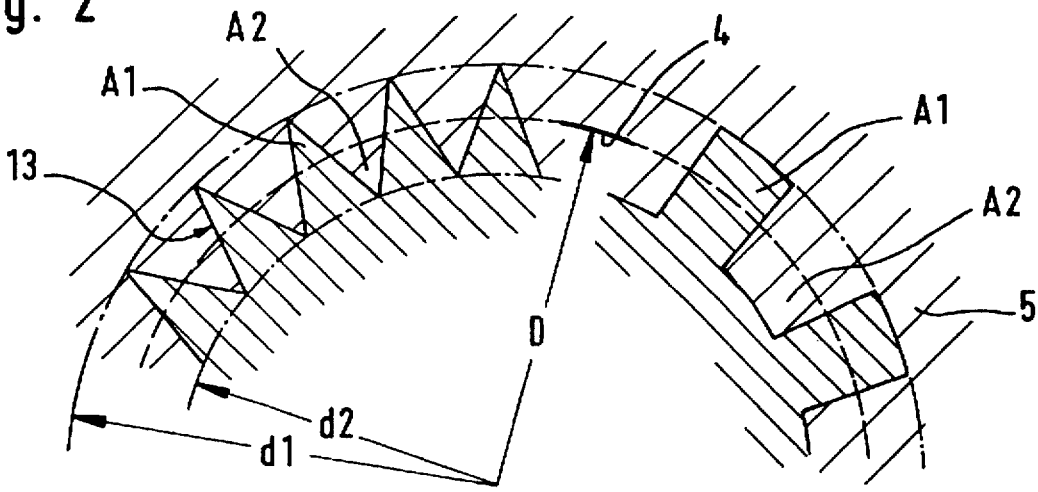
FIG. 2, a partial section taken along line II—II of FIG. 1.

As can be seen more particularly in FIG. 2, the diameter D of the reception bore 4 of the cylinder head 5 is larger than the diameter d2 of the envelopping circle of the root of the toothing and smaller than the diameter d1 of the envelopping circle of the serration toothing 13. During the formation of the press-fit, the material in the areas A1 which are defined by the diameter D and the diameter d1 is displaced into the area A2 which is defined by the diameter D and the diameter d2. Advantageously, the area A1 is smaller than the area A2 because such a ratio permits an unhindered displacement of material. As can be seen further in FIG. 2, the serration toothing 13 is triangular or rectangular in shape. However, other shapes are also conceivable.

FIGS. 3 and 4 show that the lower end of the reception bore 4 comprises a step 14 and that the serration toothing 13 possesses a conically tapering end region. Such a configuration permits a particularly firm seating of the support element 1 in the reception bore 4.

Figure 5:
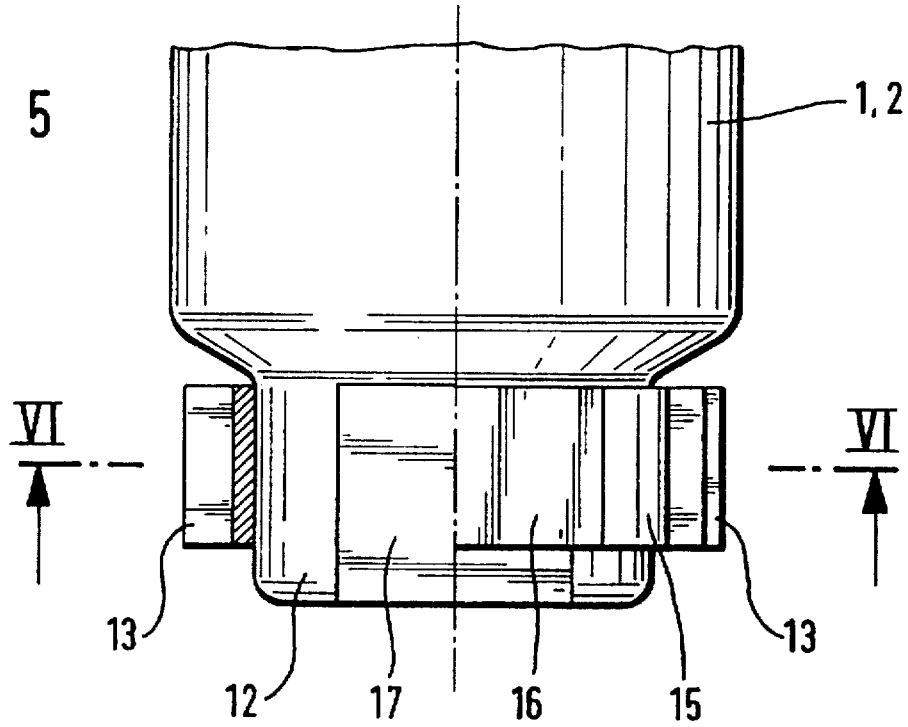
FIG. 5, a projected view of a support element having a toothed bushing, with a broken-out section and FIG. 6, a cross-section taken along line VI—VI of FIG. 5.
Figure 6:
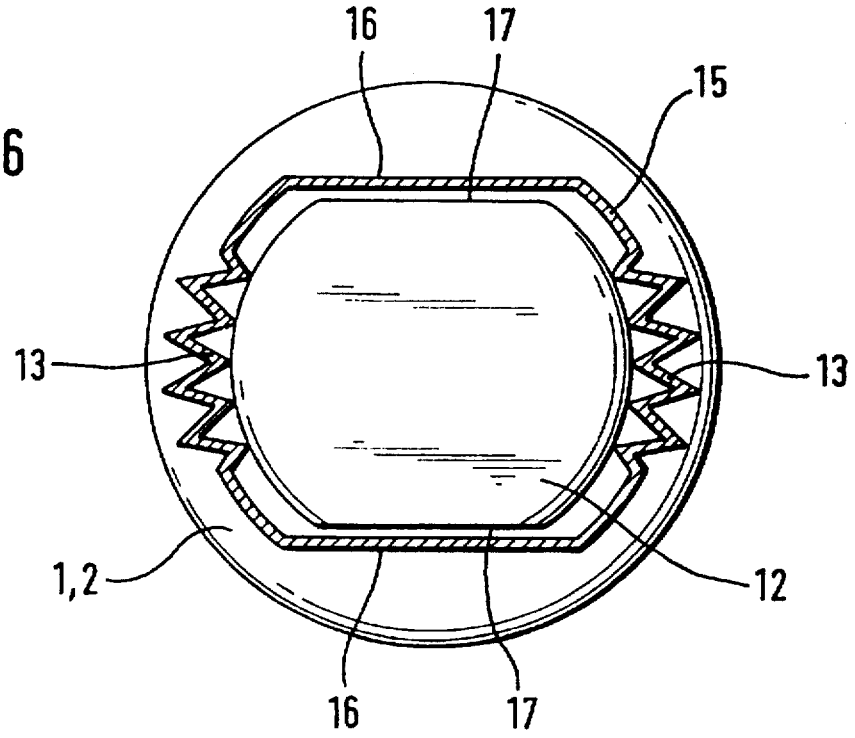

FIGS. 5 and 6 show a support element 1 whose housing 2 is provided with a bushing 15 in its lower region 12. The serration toothing 13 is arranged in two opposing regions of the bushing 15 which is pressed into the reception bore 4 of a cylinder head 5 in the described manner. The bushing 15 is ring-shaped and comprises two opposing flattened portions 16 which correspond to two flattened regions 17 of the housing 2, i.e. the bushing 15 is connected positively to the housing 2. This method of fixing the support element 1 in the reception bore 4 permits a dismounting of the support element, i.e. the support element has only to be pulled out upwards out of the press-fitted bushing 15.

I claim:

1. A support element (1) for a finger lever of a valve drive of an internal combustion engine comprising a hollow cylindrical housing (2) arranged in a reception bore (4) of a cylinder head (5), a slidable inner element (6) arranged within the housing (2) being supported by a compression spring on the housing (2), while one end of the housing (2) cooperates with the cylinder head (5), and one end of the inner element (6) cooperates with the finger lever, characterized in that an outer peripheral surface of the housing (2) comprises a serration toothing (13) which is pressed into the reception bore (4) during mounting.

2. A support element (1) according to claim 1, characterized in that the housing (2) is connected positively to a bushing (15) on whose outer peripheral surface, there is arranged a serration toothing (13) which is pressed into the reception bore (4) during mounting.

3. A support element (1) of claim 1, wherein the serration toothing (13) extends over the entire periphery or over a part thereof and is arranged in an end region (12) of the housing (2).

4. A support element (1) of claim 1, wherein a diameter D of the reception bore (4) is larger than a diameter d2 of an enveloping circle of the root of the toothing and smaller than a diameter d1 of an enveloping circle of the serration toothing (13).

5. A support element (1) of claim 4, wherein an area A1 defined by the diameter D and the diameter d1 is smaller than an area A2 defined by the diameter D and the diameter d2.

6. A support element (1) of claim 1, wherein, viewed in cross-section, the serration toothing (13) has a triangular or a rectangular configuration.

7. A support element (1) of claim 1, wherein a lower end of the reception bore (4) comprises a step (14).

8. A support element (1) of claim 1, wherein the serration toothing (13) comprises a conically tapering end region.

9. A support element (1) of claim 2, wherein the housing (2) and the bushing (15) comprise at least one flattened portion (17, 16) each, and the bushing (15) comprises the serration toothing (13) in two regions situated diametrically opposite each other.

10. A support element (1) of claim 2, wherein the bushing is ring-shaped.

11. A support element (1) of claim 1, wherein the outer peripheral surface of the housing (2) comprises at least one flattened portion which cooperates with an associated flattened portion in the reception bore (4) of the cylinder head (5).

12. A support element (1) of claim 2, wherein the outer peripheral surface of the bushing (15) comprises at least one flattened portion which cooperates with an associated flattened portion in the reception bore (4) of the cylinder head (5).

* * * * *